US005975664A

United States Patent [19]

Banicevic et al.

[11] Patent Number: 5,975,664

[45] Date of Patent: Nov. 2, 1999

[54] FRENCH DOOR GASKET CORNER SEAL

[75] Inventors: Nedo Banicevic, Hamilton; Les A. Jeziorowski, Coquitlam, both of Canada

[73] Assignee: Camco Inc., Mississauga, Canada

[21] Appl. No.: 09/170,006

[22] Filed: Oct. 13, 1998

[30] Foreign Application Priority Data

Jun. 5, 1998 [CA] Canada ..... 2239746

[51] Int. Cl.[6] ..... A47B 96/00

[52] U.S. Cl. ..... 312/405; 49/478.1

[58] Field of Search ..... 49/309, 310, 366, 49/478.1, 479.1, 480.1, 483.1, 495.1; 312/296, 405, 400, 405.1

[56] References Cited

U.S. PATENT DOCUMENTS

| | | | |
|---|---|---|---|
| 1,918,911 | 7/1933 | Hull . | |
| 2,565,891 | 8/1951 | Sherman | 292/1 |
| 2,692,809 | 10/1954 | Kesling | 312/214 |
| 2,723,896 | 11/1955 | Wurtz | 312/296 |
| 3,004,309 | 10/1961 | Korodi | 20/69 |
| 3,070,852 | 1/1963 | Hilliker | 20/16 |
| 3,077,644 | 2/1963 | Kesling | 20/69 |
| 3,216,776 | 11/1965 | Carbary | 312/296 |
| 3,226,367 | 12/1965 | Monti | 20/69 |
| 3,248,159 | 4/1966 | Hall | 312/296 |
| 3,264,048 | 8/1966 | Koch et al. | 312/296 |
| 3,362,108 | 1/1968 | Jones | 49/478 |
| 3,382,618 | 5/1968 | Townsend | 49/483 |
| 3,408,772 | 11/1968 | Frehse | 49/366 |
| 3,461,610 | 8/1969 | Peters et al. | 49/478 |
| 3,466,804 | 9/1969 | Swaneck, Jr. | 49/483 |
| 3,487,581 | 1/1970 | Ellinson, Jr. | 49/478 |
| 3,726,578 | 4/1973 | Armstrong | 312/214 |
| 3,942,853 | 3/1976 | Grimm et al. | 312/296 |
| 4,226,489 | 10/1980 | Haag | 312/296 |
| 4,288,135 | 9/1981 | Buchser et al. | 312/296 |
| 4,469,383 | 9/1984 | Losert | 312/296 |
| 4,644,698 | 2/1987 | Gerdes et al. | 49/478 |
| 4,653,819 | 3/1987 | Swerbinsky | 312/296 |
| 4,702,038 | 10/1987 | Frey | 49/478 |
| 4,732,432 | 3/1988 | Keil et al. | 312/214 |
| 4,832,396 | 5/1989 | Moreno et al. | 296/164 |

(List continued on next page.)

FOREIGN PATENT DOCUMENTS

| | | | |
|---|---|---|---|
| 1146621 | 5/1983 | Canada | 312/73 |
| 490928 | 8/1994 | European Pat. Off. | 3/6 |

*Primary Examiner*—Peter M. Cuomo
*Assistant Examiner*—Gerald A. Anderson

[57] ABSTRACT

A refrigerator cabinet has a food storage compartment bounded by front facing vertical and horizontal walls. A pair of French doors are pivotally mounted to the refrigerator cabinet to close the open front of the refrigerator. In the closed position the doors have vertically extending confronting walls which include an intermediate sealing gasket extending along a major vertical portion of the confronting walls which are adapted to sealingly engage against each other to form a vertically extending seal. Upper and lower corner sealing gasket members are respectively positioned above and below the intermediate sealing gasket members and adjacent a corresponding horizontal wall of the cabinet. Each of the corner sealing gasket members has a first sealing surface adjacent the intermediate sealing gasket member to complete the vertical seal between the confronting walls of the doors when the doors are in a closed position. The corner sealing gaskets further include a second sealing surface generally orthogonal to the first sealing surface. The second sealing surface in an open position has one vertically extending outwardly protruding ridge contracting the second sealing surface to withdraw the first sealing surface back from its vertical sealing position. The ridge engages one of the horizontal walls as the door closes so as to flatten the second sealing surface into sealing engagement with this horizontal wall and to advance the first sealing surface towards the location of the vertical seal position. Magnetic strips are also located in the corner sealing gasket members to facilitate the sealing of the first sealing surfaces to each other and to the front facing horizontal wall.

52 Claims, 13 Drawing Sheets

U.S. PATENT DOCUMENTS

| | | | |
|---|---|---|---|
| 4,916,864 | 4/1990 | Thompson | 49/478 |
| 5,129,184 | 7/1992 | Fish | 49/478 |
| 5,289,657 | 3/1994 | Kiel | 49/478.1 |
| 5,309,680 | 5/1994 | Kiel | 49/478.1 |
| 5,425,205 | 6/1995 | Ha | 49/366 |
| 5,560,694 | 10/1996 | Banicevic et al. | 312/405 |
| 5,816,080 | 10/1998 | Jeziorowski | 62/441 |

FRENCH DOOR GASKET CORNER SEAL

TECHNICAL FIELD OF THE INVENTION

The present invention relates to a refrigerator door seal between a refrigerator cabinet and a pair of French doors. In particular it relates to corner seals mounted to the top and bottom adjacent corners of the French doors to form a seal between the adjacent corners of the French doors and against the refrigerator cabinet when the doors are closed.

BACKGROUND OF THE INVENTION

For several years the trend in domestic refrigerator cabinets has been to increase the size and in particular the width of the food compartments which brought about the use of double doors. The advantage of the larger refrigerator however, is lessened by fitting side-by-side a freezer on one side and a refrigerator on the other side of a refrigerator cabinet with a center vertical mullion against which the side-by-side doors close. Omission of the vertical mullion to maintain the freezer compartment on the top, the fresh food compartment below and yet still have side-by-side doors, introduces the problem of effectively sealing the doors along their juxtapositioned facing sides. To provide a thermal and/or air seal between the facing surfaces of the doors when the doors are closed, compressible gaskets have been developed that extend along the side face of each door and contact each other during door closure. Each gasket includes magnets extending vertically along the length of the gasket. The magnets in opposing gaskets are oppositely poled so that the magnetic poles attract when the doors are aligned in a side-by-side closed position. During door opening when one door is moved relative to the other door, like poles of the magnets pass by each other causing the magnets to repel and move the gaskets apart reducing wiping contact of the gaskets. However, once these "repelling" magnets pass by each other, gasket wiping occurs along the entire vertical length of the gasket.

Many different magnetic gasket sealing assemblies for side-by-side or "French" doors used to close an open front of a refrigerator cabinet are disclosed in the U.S. Patent literature. For example, U.S. Pat. No. 3,248,159 issued Apr. 26, 1996 to Charles Hall teaches the use of three sets of magnets in two gaskets. A first pair of magnets are arranged to attract and seal the two gaskets when the doors are in the closed position. This first pair of magnets are hingedly attached in a flexible gasket to a second pair of magnets, one in each gasket which pivot the gasket sealing faces to move the first pair of magnets out of contacting position relative to each other during opening and closing of the French doors to reduce wiping. The magnetic gasket seals are arranged forward of a recessed shoulder in each of the French doors.

U.S. Pat. No. 3,264,048 issued Aug. 2, 1966 to A. J. Koch et al describes a magnetic gasket seal for French doors where the gaskets overlap each other in the direction of opening which causes a wiping action which reduces the life of the gasket. Other examples of French door magnetic gasket seals are described in U.S. Pat. No. 2,723,896 issued to Wurtz on Nov. 15, 1955; U.S. Pat. No. 3,408,772 issued to Frehse on Nov. 5, 1968; U.S. Pat. No. 4,226,489 issued Oct. 7, 1980 to Charles Haag; U.S. Pat. No. 4,288,135 issued Sep. 8, 1981 to Buchser et al; U.S. Pat. No. 5,289,657 issued Mar. 1, 1994 to Lowell Kiel and U.S. Pat. No. 5,309,680 issued May 10, 1994 to Lowell Kiel. All of these French door closure gasket seals are subject to wiping along the entire vertical length of the adjacent facing gaskets during closure thereby effecting the proper closure of the doors and gasket sealing integrity over the life span of the gasket.

The aforementioned patents are concerned with sealing of French doors by using sealing gaskets with magnets that cause one or more of the door gaskets to move relative to the other gasket during opening/closing operation to reduce the effects of wiping. These patents do not address the problem associated with continued simultaneous swiping of gaskets along the entire vertical length of the gasket the doors are moved into a closed position. This wiping action reduces the longevity of the door seal integrity between adjacent doors and provides the user with an un-sure feeling that the door may not be properly closed. In some instances, the force used to close the door may be insufficient to overcome the wiping along the length of the gaskets leaving the doors partially ajar.

French door gaskets must seal along their entire vertical length, which for the most part extends between the upper and lower peripheral walls of the refrigerator cabinet to provide an effective seal which also creates the problematic wiping along the vertical length of the gaskets. Further, as the width of the refrigerator cabinet increases and the size the weight of the double doors increases. This increases the stress placed on door sealing gaskets. As a result the effects of prolonged wiping along the vertical lengths of these gaskets affixed to the opposing juxtapositioned sides of the refrigerator may cause premature gasket deterioration and misalignment shortening the life of the seal. While the use of a vertical mullion overcomes this problem because the entire length of the sealing gasket can close against the vertical mullion to distribute evenly the door closing forces along the length of the gasket and mullion, the use of the mullion defeats the purpose of providing a refrigerator cabinet having a single access to either or both of the fresh food compartment and the freezer food compartment when these compartments are positioned vertically above one another. Clearly, the patent literature for at least the last 40 years has recognized the difficulty in manufacturing an effective French door gasket seal between vertically extending and confronting side walls of the side by side doors.

In order to overcome the aforementioned problems with respect to the eliminating of the swiping contact along the vertical length of the confronting seals during door closure, reference may be had to my corresponding Canadian Patent Application Serial Number 2,231,319 filed Mar. 5, 1998 entitled Refrigerator Door Seal Assembly. This co-pending patent application sets out a novel door seal closure arrangement for French doors.

While most of the previous patents referred to hereinabove are directed towards French door seals, it should be understood that these seals extend along the surface of the vertical extending confronting sidewalls of the doors. In many instances, the seals extend rearwardly of the sidewalls of the door and are able to engage the horizontal front facing walls that define the top and bottom walls of the refrigerator food storage compartment. However, none of these patents describes a separate corner seal gasketing mechanism for effecting a proper seal along the vertical confronting sidewalls of the French Doors and against the horizontal open or front facing walls of the refrigerator cabinets.

U.S. Pat. No. 4,288,135 issued Sep. 8, 1981 issued to Buchser et al discloses an end cap ceiling element for closing off air gaps provided by two adjacently spaced apart seals of the confronting walls of the French Doors. This patent teaches an air space between the two seals and the top and bottom of the doors having end caps that seal the ends of the air space. However, this patent is not concerned with the reduction of any swiping contact at the corners of the French Gasket Doors while still maintaining a good seal against the front facing horizontal walls of the refrigerator compartment adjacent the corners of the confronting walls of the French doors.

Accordingly, there is a need for being able to provide an effective seal at the upper and lower corners of French doors used in a refrigerator to permit for the doors to be opened and closed relative to each other with minimal wiping while at the same time providing a good seal between the ends of the confronting sidewalls and against the front facing horizontal walls of the refrigerator cabinet.

SUMMARY OF THE INVENTION

The present invention relates to a novel corner sealing arrangement for use with French doors of a refrigerator which doors close a single access opening into a food compartment for the refrigerator. The food storage compartment has an open front bounded by front facing vertical and horizontal walls. The doors are pivotally mounted to the refrigerator to close against the front facing vertical and horizontal walls and form a vertical seal between adjacent vertically extending confronting walls of the doors. Upper and lower corner sealing gasket members are mounted to top and bottom ends of at least one of the doors adjacent the vertical seal and corresponding horizontal walls of the refrigerator when this door is in a closed position.

In the present invention, each of the upper and lower corner sealing gasket members include first and second sealing surfaces. The first sealing surface generally forms a continuum of, or continuous sealing surface with, the vertical seal between the confronting walls when the doors are in a closed position. This is referred to throughout the disclosure and claims as the vertical seal position for the first sealing surface. The second sealing surface is generally orthogonal to the first sealing surface and has at least one vertically extending protruding ridge contracting the second sealing surface to withdraw the first sealing surface back towards the ridge when the one door is in an open position. The ridge engages a corresponding horizontal wall as the door closes to flatten the second sealing surface into sealing engagement with the corresponding horizontal wall and to advance the first sealing surface towards the vertical seal position. It should be understood that it requires both doors to be closed to effect the vertical seal, however, each door advances its corner sealing gasket members toward the vertical seal position independently of the position of the other door. Thus the corner gasket sealing members contact the horizontal wall at the ridge on the second sealing surface which moves the first surface into a final position adjacent the vertical seal position once the door is closed against the compartment. The corner gasket sealing members of the doors do not touch each other during closure of either door relative to the other until both doors reach a closed position against the horizontal wall of the refrigerator compartment. By flattening the ridge to advance the first sealing surface, the corner gasket sealing members do not cause the doors to jam at the corners during closure while at the same time allow the second sealing surface to reach along the horizontal compartment wall and form an effective seal with the horizontal wall.

To facilitate the expansion of the vertically extending ridge during the flattening of the second sealing surface, each of the corner sealing gasket members may further include at least one elongate first accordion fold located on a outer surface of the gasket member adjacent a corner where the vertical and horizontal sealing surfaces meet. The elongate first accordion fold extends in a direction generally parallel to the first sealing surface and generally orthogonal to the second sealing surface when the door is in the open position with the first sealing surface retracted away from the vertically sealing position. The elongate first accordion fold expands in width and shortens in length as the first sealing surface moves towards the vertical seal position.

To improve the efficiency of the seal along the second or horizontal sealing surface, the corner seal gasketing member may further include a rear or inside face on the opposite side of a portion of the horizontal sealing surface. This inside face preferably includes a hinged second accordion fold. The second accordion fold extends down along the inside face in line with the elongate first accordion fold. The fold is centered relative to the contacting or vertically extending ridge when the door is open. The second accordion fold includes two legs extending outwardly from the rear surface and a hinge corner between the legs. As the contacting ridge contacts the horizontal wall of the refrigerator, the contacting ridge flattens bringing the horizontal or second sealing surface into sealing engagement with the horizontal wall. As this happens, the legs of the second accordion fold buckle to spread the middle portion of the legs apart from each other. This also causes the second accordion fold to move and hinge towards the first accordion fold to create a crease between these folds. This creasing action permits for the outer surface of the corner gasket sealing member to deform in response to the stresses associated with the closure of the door.

In an alternative embodiment, the ridge is positioned between the first and second sealing surfaces when the doors are open. When the doors close, the ridge engages a horizontal wall of the refrigerator to flatten and cause the corner of the ridge to expand towards the vertical seal position.

Preferably, the vertically extending ridge contracts horizontally to withdraw with horizontal displacement the first sealing surface back from the vertical seal position when the door is opened. While more than one ridge is within the realm of the present invention, preferably one ridge is employed. The shape of the ridge can be of any shape that allows the ridge to temporary deform or flatten causing the first sealing surface to reach towards the vertical seal. One shape contemplated is that of a triangular ridge. In the preferred embodiment, the shape of the ridge is generally arcuate in cross-section. Preferably, the arcuate cross-section of the ridge has a radius when the door is open that is proportional to the horizontal displacement or reach of the first sealing surface when the door is closed. Preferably, the ridge is completely removed or flattened when the doors are closed.

Preferably, the second sealing surface forms a continuum of, or continuous sealing surface with peripheral door mounted cabinet sealing gaskets. Preferably, the first sealing surface is a continuum with the sealing surface of the type of vertical extending sealing gaskets located on confronting side walls of the doors that are described in my afforementioned co-pending Canadian patent application S.N. 2,231,319.

The corner sealing gasket members preferably include first magnets located adjacent the first and second sealing surfaces for forming the vertical seal adjacent the front facing horizontal walls. The front facing horizontal walls preferably also include magnetic attraction members adjacent the vertical seal to attract the first magnets towards the front facing horizontal walls. Further vertically extending second magnets are positioned in the corner sealing gasket members adjacent the first sealing surface for mutual attraction to form the vertical seal. The corner gasket sealing member has a hinge web along a surface forward of the first sealing surface and further includes second retraction magnets located in each of the corner sealing gasket members spaced rearwardly from the second magnets to attract the second magnets to the second retraction magnets withdrawing the first sealing surface away from the vertical seal when at least one door is open. Also, first retraction magnets are located in each of the corner sealing gasket members spaced rearwardly from the first magnets to attract the first magnets to the first retraction magnets withdrawing the first sealing surfaces from the vertical seal when the one door is open. The use of the second retraction magnets facilitates the withdrawal of the first surfaces away from each other during opening of a respective one or both of the doors. The first retraction magnets facilitates the retraction of the first sealing surface of the corner seal gasketing member at its corner as a respective door is open.

In accordance with a broad aspect of the present invention there is provided a refrigerator having at least one food storage compartment with an open front bounded by front facing vertical and horizontal walls. The refrigerator includes a pair of French doors pivotally mounted to the refrigerator to close against the front facing vertical and horizontal walls and form a vertical seal between adjacent vertically extending confronting walls of the doors. The doors include upper and lower corner sealing gasket members positioned on top and bottom ends of at least one of the doors adjacent the vertical seal and corresponding horizontal walls of the refrigerator when the door is in a closed position. Each of the upper and lower corner sealing gasket members include first and second sealing surfaces. The first sealing surface has a vertical seal position where the first sealing surface generally forms a continuum of the vertical seal between the confronting walls when the doors are in a closed position. The second sealing surface is generally orthogonal to the first sealing surface. The second sealing surface has at least one vertically extending protruding ridge contracting the second sealing surface to withdraw the first sealing surface back towards the ridge when the one door is in an open position. The ridge engages a corresponding horizontal wall as the door closes to flatten the second sealing surface into sealing engagement with the corresponding horizontal wall and to advance the first sealing surface towards the vertical seal position when both doors are closed.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF EMBODIMENTS

Figure 1:
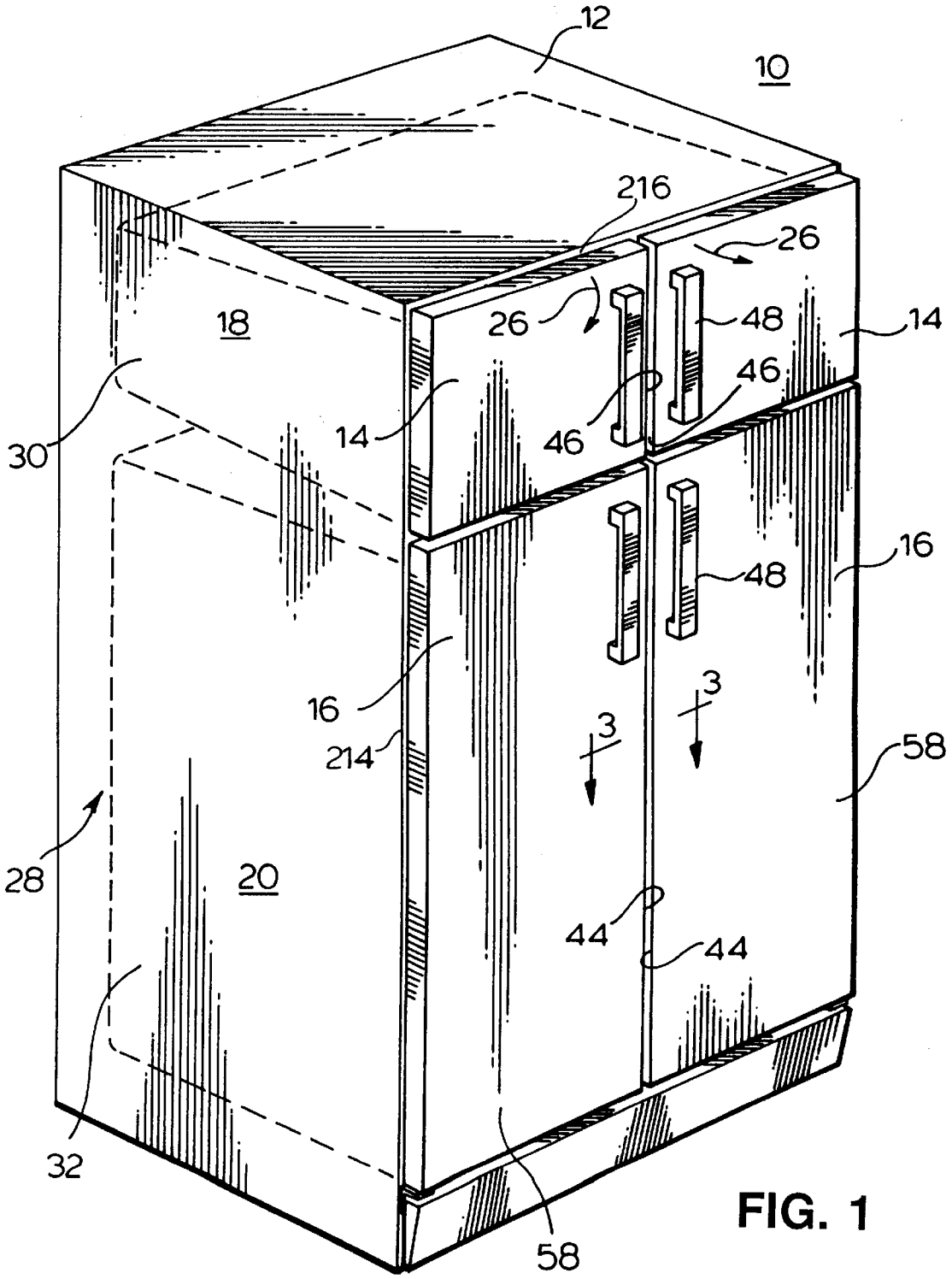
FIG. 1 is a perspective view of a refrigerator having side-by-side, or "French" doors in accordance with the present invention.
Figure 2:
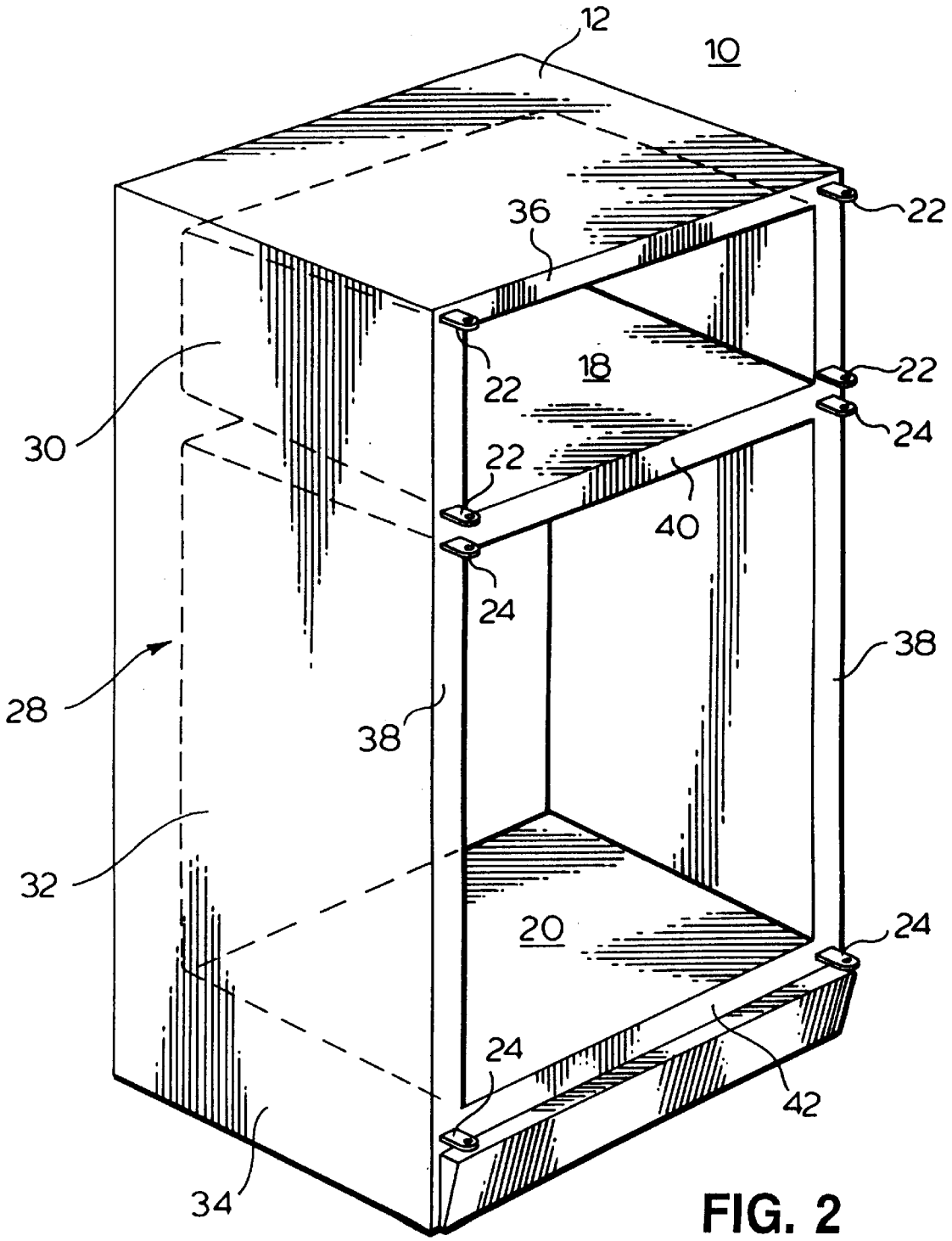
FIG. 2 is a perspective view of the refrigerator cabinet of the present invention with the side-by-side doors removed.

Referring to FIGS. 1 and 2 there is shown a refrigerator 10 having a cabinet 12 with two pairs of French doors 14 and 16 secured in a side-by-side closed position. The upper pair of French doors 14 are adapted to close the freezer food compartment 18 and the lower pair of French doors 16 are provided to close off the fresh food compartment 20. The upper pair of doors 14 are connected to the refrigerator cabinet by hinges 22 while the lower pair of French doors 16 are connected to the refrigerator cabinet through lower hinges 24. The hinge structure may be any suitable hinge provided in the art and forms no part of the present invention. The pair of doors 14 and the pair of doors 16 pivot about their respective hinges from an open position permitting access to compartments 18, 20 to the closed position shown in FIG. 1.

The construction of the refrigerator cabinet 12 shown in FIG. 2 comprises inserting a plastic compartment bubble liner 28 having an upper bubble 30 and a lower bubble 32, into an assembled refrigerator casing 34. Refrigerator casing 34 is typically formed from sheet metal and may have dimples on the side and top walls to provide a textured effect. The refrigerator casing 34 has front perimeter walls which comprise top wall 36, side walls 38, mullion wall 40 and bottom wall 42. It should be understood that the mullion wall 40 forms what is referred to throughout the specification as the top front facing horizontal wall of the fresh food compartment 20. Additionally, the mullion 40 forms the bottom front facing horizontal wall for the food compartment 18, typically the freezer compartment. It should be understood that each of these front facing peripheral vertical 38 and horizontal walls 36, 40 and 42 may be formed from either the sheet metal material of the casing 34 or alternatively a leading edge plastic retainer profile which acts to hold the bubble liner 28 within the metal casing 34. Once assembled, the empty spaces in the refrigerator are filled with foam in place.

Before describing the gasket corner sealing of each of French door pairs 14, 16, a description of the intermediate sealing gaskets that extend vertically substantially the length of the doors between the gasket corner seals is first described with reference to FIGS. 3 to 6. It will be appreciated that the description with respect to doors 16 also is applicable to doors 14.

Figure 3:
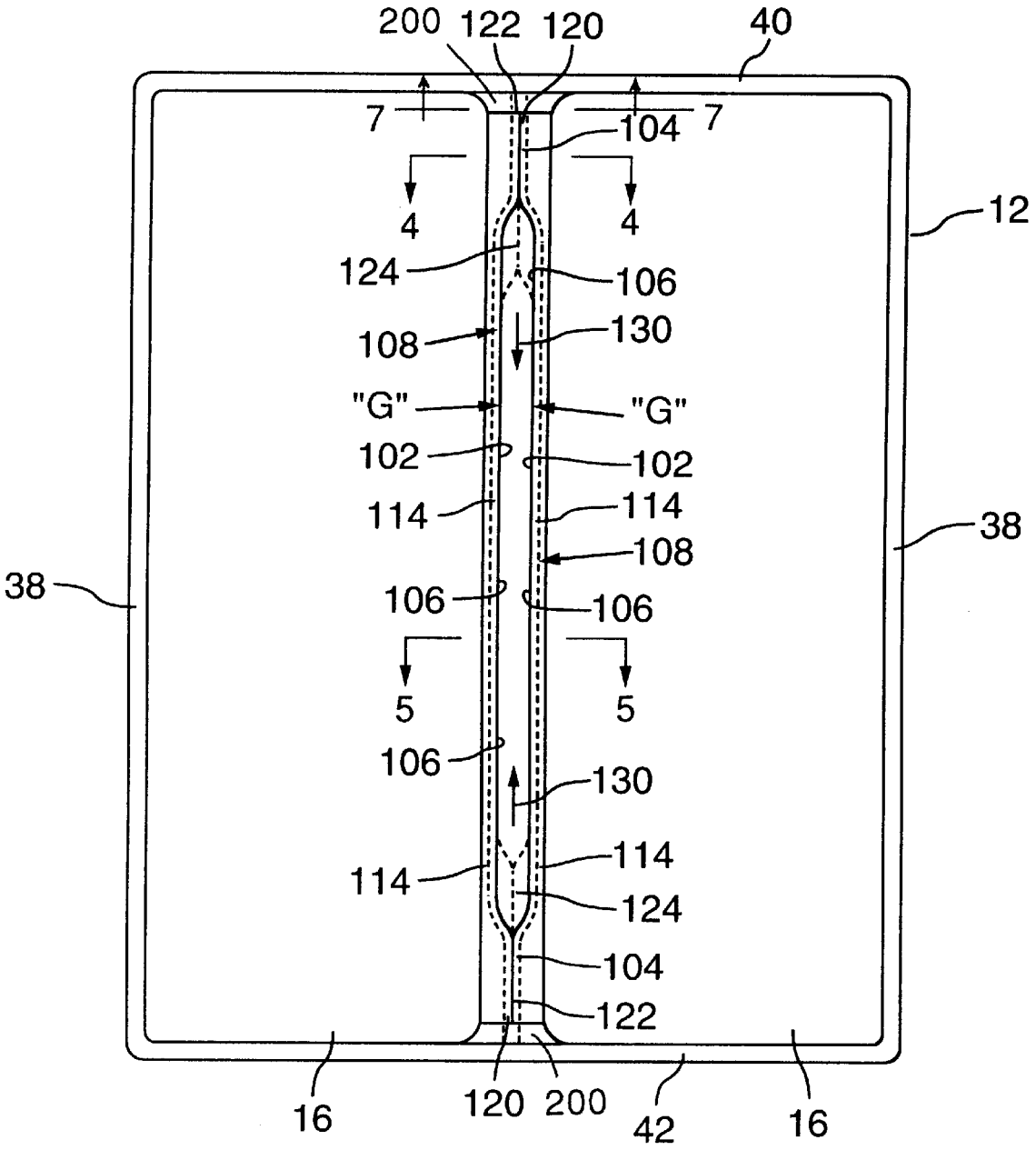
FIG. 3 is a view showing the use of two movable intermediate gasketing members in accordance with the preferred embodiment.

The intermediate sealing gaskets of FIGS. 3 to 6 illustrate the gasketing described in my aforementioned Canadian patent application Serial No 2,231,319 described the preferred embodiment and form no part of the present invention other than to in which the present invention is employed. FIG. 3 shows the doors 16 in the temporary intermediate partially closed position. Doors 16 extends over the open front of refrigerator compartment 12. The French doors 16 have vertically extending confronting side walls 102. Near the upper and lower ends of the refrigerator doors 16, the confronting side walls 102 are in wiping and sealing contact at 104. The confronting side walls 102 include temporary non-sealing vertically extending portions 106 that are spaced apart from one another by a predetermined gap distance "G". This predetermined gap distance is sufficient to allow either one or both of the doors 16 to close relative to the other door without the non-sealing vertically extending portions 106 of the confronting side walls 102 swiping each other. Each of the confronting side walls 102 includes a movable sealing gasket member 108.

Figure 5:
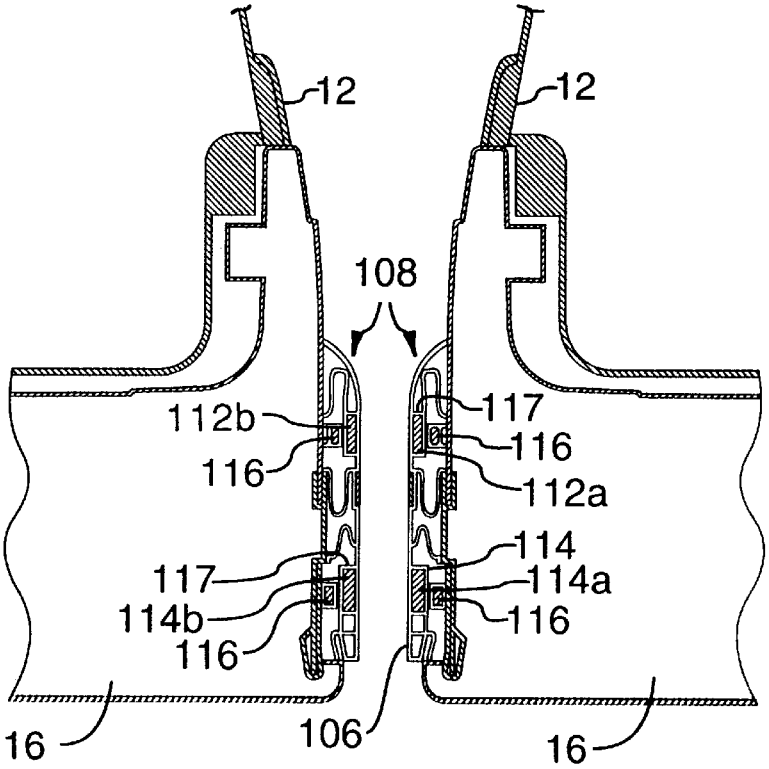
FIG. 5 is a sectional view taken at lines 5—5 of FIG. 3.
Figure 6:
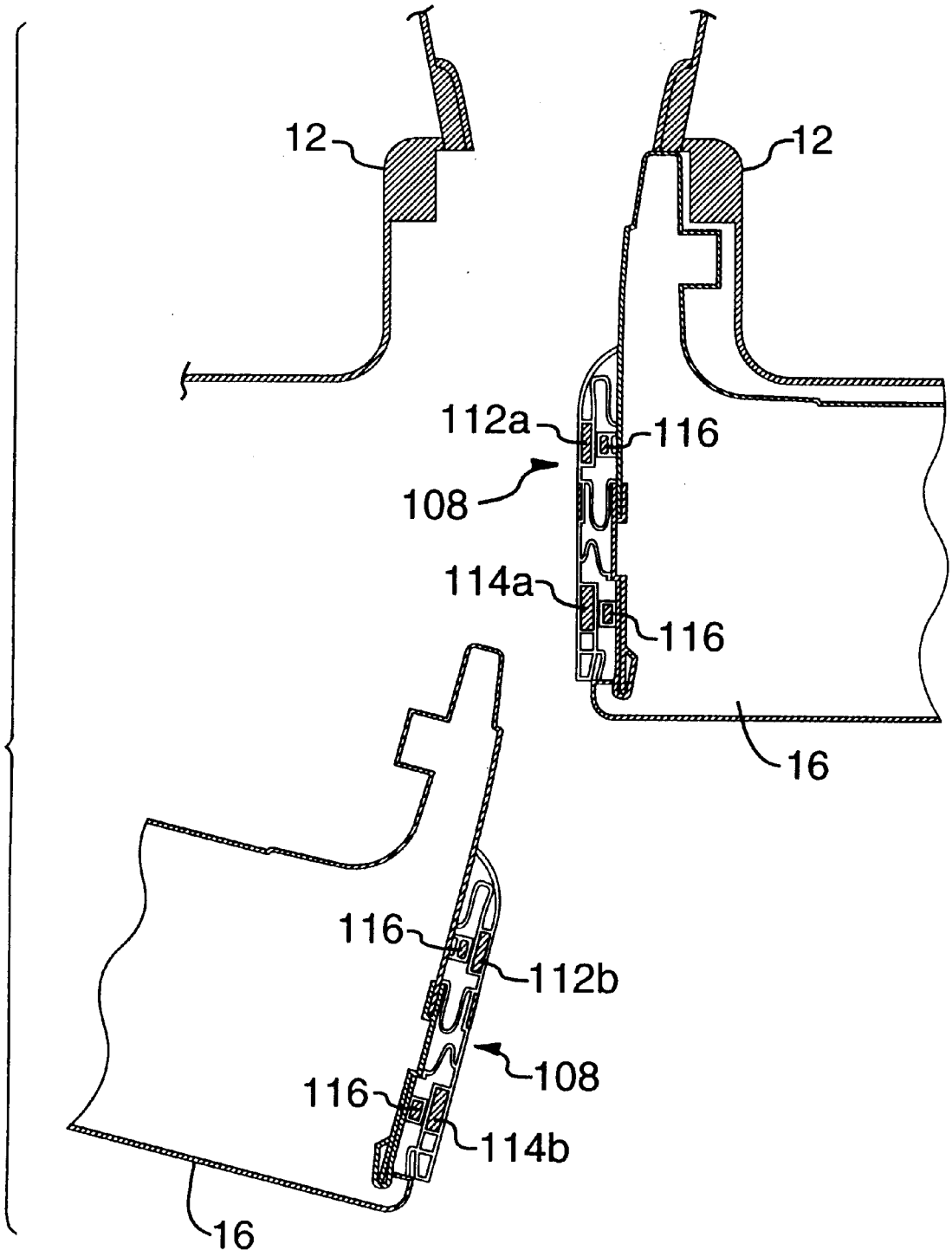
FIG. 6 is a sectional view taken at lines 5—5 of FIG. 3 with one of the doors moved into an open position.

In FIG. 5, the gasketing members 108 each include first magnetic attraction means comprising elongate flexible magnet pairs 112(*a*) & (*b*) and 114 (*a*) & (*b*). Each of the magnet pairs comprises two magnets having adjacent surfaces oppositely polled so as to provide an attraction magnetic force. The magnetic attraction force of the magnetic pairs 112 and 114 is selected to be insufficient to cause the magnet pairs 112 and 114 to move the gaskets 108 into contacting and sealing engagement across the predetermined gap distance. In FIG. 5 the magnet pairs 112 and 114 extend along the temporary non-sealing vertically extending confronting surfaces 106. The first magnet pair 112 is located laterally forward of the second magnetic pair 114 so as to provide to vertically extending surfaces on the gaskets 108 that sealingly engage each other once the predetermined gap distance has been reduced. The strip magnet pairs 112 and 114 are located within hollow elongate chambers 117 adjacent an inner surface of the gasketing member. The hollow chambers 117 are carried by the gasketing member outer wall and flexible webs permit movement of the outside wall of the gasket members 108 relative to each other. The gasketing members 108 further include third magnet means in the for of strip magnets 116 which also vertically extend along the confronting door surfaces. As shown in FIGS. 5 and 6, the purpose of the third magnets 116 is to assist in the retraction of the gasketing member 108 along the temporary non-sealing portions of the gasket so that when the doors 16 are closed, the gasketing members are in a retracted non-swiping position.

Figure 4:
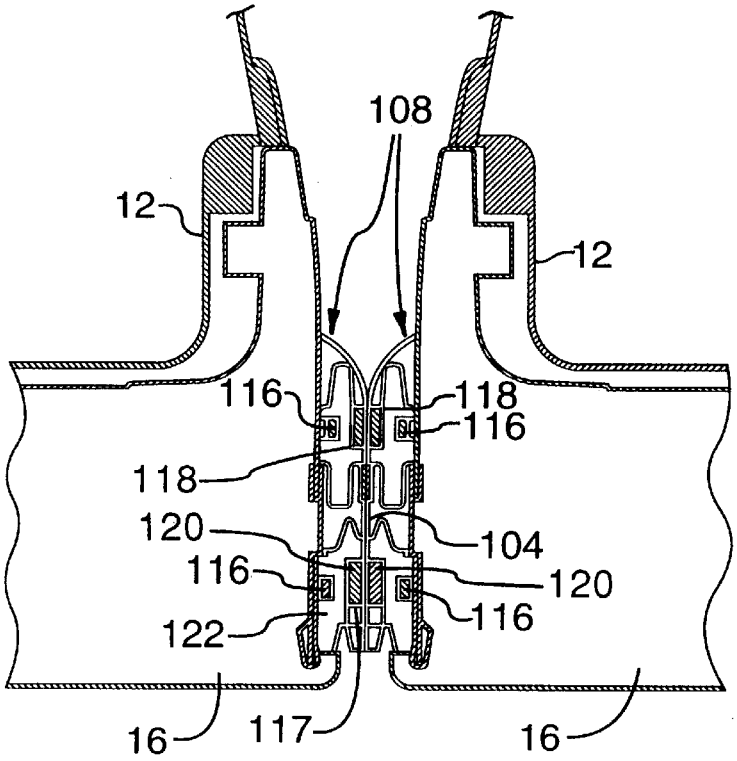
FIG. 4 is a sectional view taken at lines 4—4 of FIG. 3.

In FIG. 4, the ends of the gasketing members 108 near the top and bottom portions of the doors 16 have second magnet attraction means in the form of ceramic magnets pairs 118 and 120 that have a magnetic field or strength greater than the magnetic strength of the flexible magnet pairs 112 and 114. The ceramic magnet pairs 118 and 120 are carried in the same hollow chambers 117 as the first magnetic pairs 112 and 114. The strength of the ceramic magnets 118 and 120 is sufficient to cause the movable gasketing members 108 to contact or swipe each other during movement of the doors into the partially closed position. The ceramic magnet pairs 118 and 120 contact each other at a local area along the confronting side walls 102. This localized area is shown as 122 in FIG. 3.

It should be understood that the cross-section of FIG. 4 could also be the cross section at 5—5 of FIG. 3 when the doors 16 are in their closed position where the ceramic magnets 118, 120 are replaced by magnets 112, 114. Once the ceramic magnet pairs 118 and 120 move into swiping contact with each other the gap distance between the gasketing members 108 adjacent the ceramic members is reduced to be less than the predetermined gap distance. In FIG. 3, while this Figure has been referred to as showing doors 16 in the partially closed position, it should be understood that the Figure actually shows the doors 16 in a partially closed position with the flexible magnetic strips 114, 116 of the gasketing members 108 in the process of closing the gap between the confronting surfaces 106. This is illustrated by broken lines showing the closure of the gap as the gasketing member 108 closes vertically away from the ceramic magnets 120 in the direction of converging arrows 130. Typically the ceramic magnets 118, 120 are 1 to 1.5 inches in length with the flexible magnets 112 and 114 extending over a majority of the vertical length of the confronting surfaces 102 of the refrigerator doors 16 which could be as much as 33 inches or more. Further, if necessary additional ceramic magnets can be placed in the hollow chambers 117 of the gasketing members 108 towards the middle of the refrigerator doors 16 between the top and bottom ends thereof to reduce the time seal the doors.

In this preferred embodiment during door closure, the doors 16 are in the temporary intermediate partially closed position with the ceramic magnet pairs providing localized gasket contact. This reduces the predetermined gap distance between the confronting walls of the gasketing members 108 initially adjacent the localized contact areas. As a result, the flexible magnetic strips move towards each other continually reducing and closing the predetermined gap distance in a sliding closure motion.

The magnetic polarities of magnetic strips 112*a*, 112*b* are chosen to be opposite to attract these magnet pairs when the doors are closed. The magnetic polarities of magnet strips 114*a*, 114*b* are also opposite to attract these magnet pairs when the doors are closed. This is similar to the polarities shown for magnets 72*a*, 72*b*, 74*a*, and 74*b* in FIG. 3. The polarities of magnetic strips 112*a*, 114*b* and strips 112*b*, 114*a* are the same to cause these magnet pairs to repel each other as the magnets pass by each other during swinging movement of one door relative to other. It should be understood that the gap distance between doors may change as the identically polled pairs 112*a*, 114*b* and 112*b*, 114*a* pass by each other in a repelling relation. The magnetic polarities of the trigger magnets pairs 118 and 120 are chosen to be the same as the magnetic strips pairs 112 and 114, respectively.

Referring to FIGS. 3 and 7 to 14, the preferred embodiment of the present invention is shown to comprise upper and lower corner sealing gasket members 200 mounted to a confronting surface corner of each of the French Doors 16. In FIG. 3, the upper and lower corner sealing gasket members 200 are shown to have extending between them the intermediate sealing gasket member 108. The upper and lower corner sealing gasket members 200 are adjacent a corresponding horizontal wall 40 for the upper sealing gasket member 200 and a lower horizontal wall 42 for the lower corner sealing gasket member.

Figure 7:
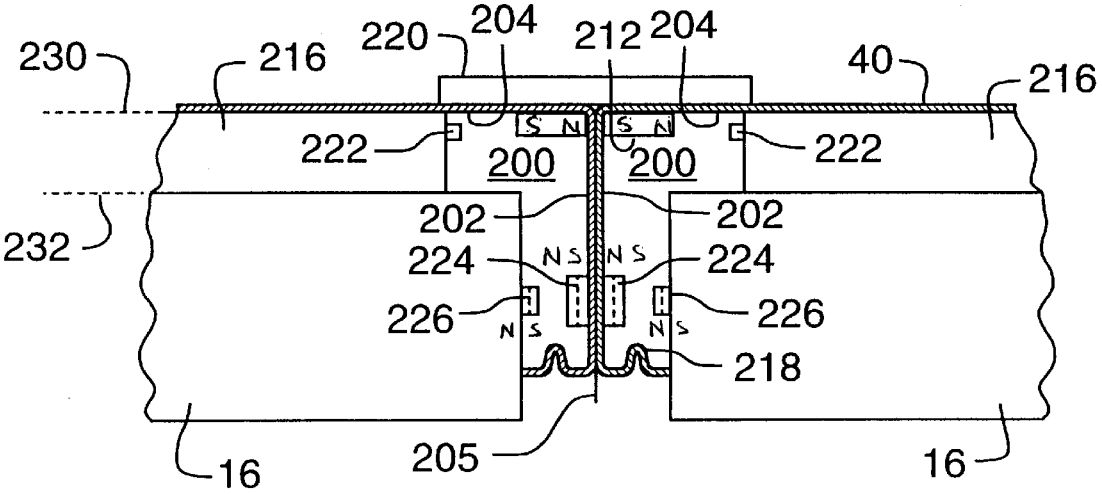
FIG. 7 is a sectional view taken at lines 7—7 of FIG. 3 showing the corner seal gasketing members of the present invention with the doors in a closed position.
Figure 8:
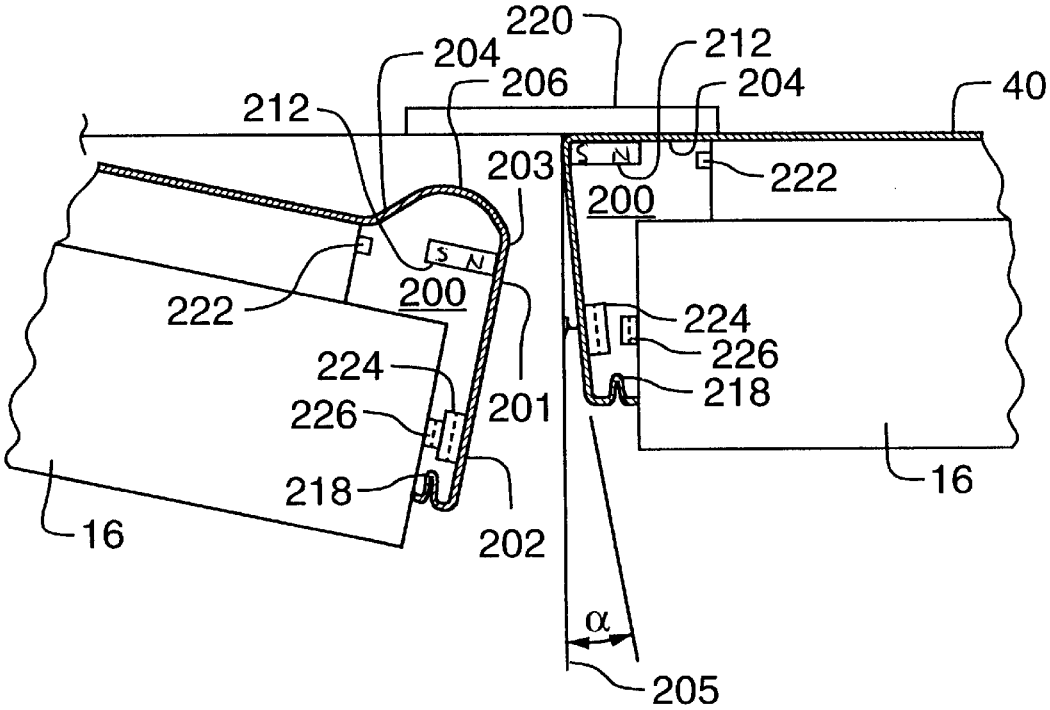
FIG. 8 is a sectional view similar to FIG. 7 showing one of the doors in an open position and one of the doors in a closed position.

FIGS. 7 and 8 illustrate sectional views of the corner sealing gasket members 200 and show the placement of magnets in the gasket members 200. Each of the upper and lower corner sealing gasket members 200 includes a first sealing surface 202 which generally forms a continuum or a continuous sealing surface adjacent the intermediate sealing gasket member 108 so as to complete the vertical seal between the confronting walls 102 of the doors 16 when the doors are in the closed position. The first sealing surface 202 extends from between the adjacent confronting sidewalls 108 of the doors rearwardly of the doors at 201 towards the refrigerator cabinet wall 42.

The corner sealing gasket members 200 further include a second sealing surface 204 orthogonal to the first sealing surface 202 when in the closed position. The second sealing surface 204 in the open position has one vertically extending outwardly protruding arcuate ridge 206 which contracts the second sealing surface 204 to withdraw the first sealing surface 202 back towards a contact ridge 206 and away from a vertical sealing position shown at line 205. The contact ridge 206 engages one of the horizontal walls 40 as the door closes to flatten the second sealing surface 204 into sealing engagement with the one corresponding horizontal wall 40. This will result in the advancement or reaching of the first sealing surface 202 towards the vertical sealing position 205 or towards the other confronting wall of the other refrigerator door when this other door is closed.

Figure 9:
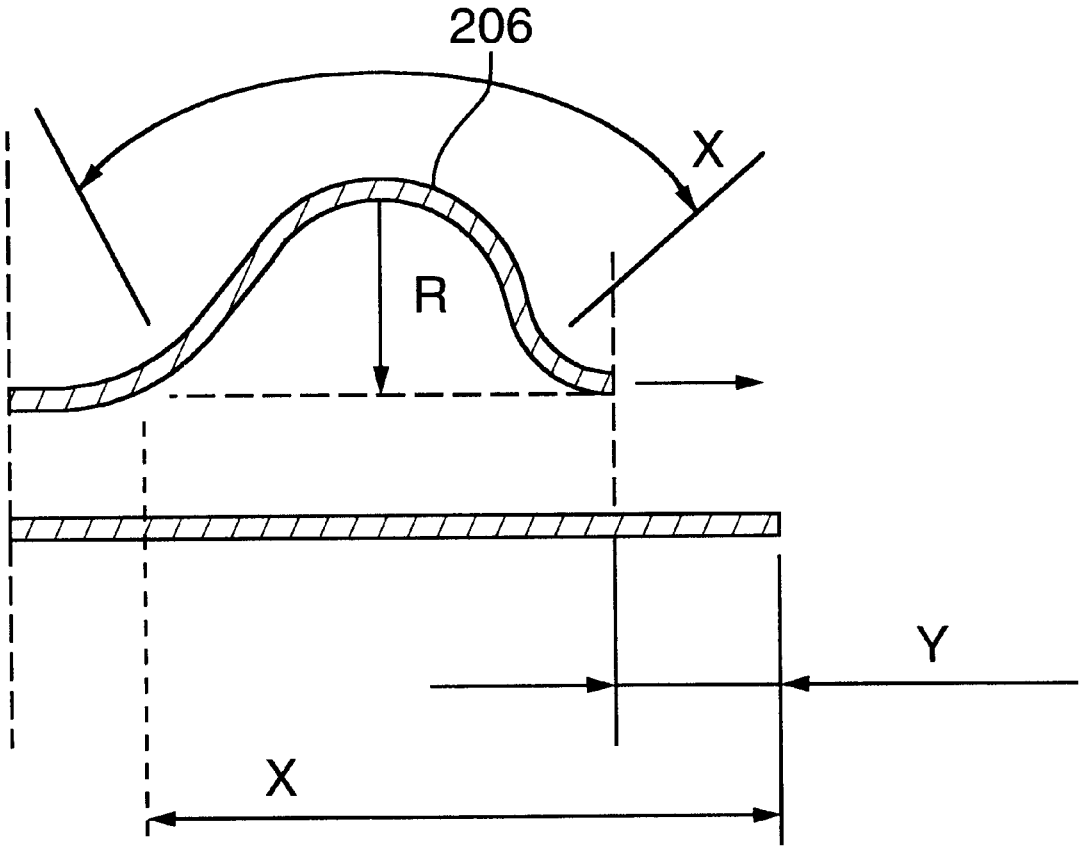
FIG. 9 is a partial perspective view of the relationship between the radius of the ridge and the horizontal displacement of the gasketing member.

Referring to FIG. 9 the peripheral distance X will result in the expansion Y in the direction of the first sealing surface movement. Accordingly, the radius R of the arcuate curvature is proportional to the amount of expansion required to cause the corner 203 of the corner gasket sealing member 200 to move to the position shown in its closed position. The expansion Y is equivalent to one half the gap distance "G". Accordingly, expansion of the corner sealing gasket 200 results in the closure of the gap between the doors at the corner seal.

In FIGS. 7 and 8, each of the corner seal gasket members 200 carries a magnet 212 at the rearward location 201 with the polarities as shown so that these magnets 212 attract each other when the doors are in the closed position. Further, a metal plate 220 is carried on the inside surface of the refrigerator cabinet horizontal wall 42. The metal plate 220 attracts the magnets 212 to cause the doors to seal against this horizontal surface. The corner sealing gasket 200 also has a first retraction magnet 222 which acts to pull the magnet 222 back towards magnet 222 and assist in reforming the ridge 206.

When one door 16 is open relative to the other, an angle shown in FIG. 8 for the closed door slopes the first sealing surface 202 away from the vertical seal position 205 to minimize wiping when the doors are subsequently closed. To provide the angle , each of the corner gasket sealing members carries with it a vertically extending magnet 224 that is shown positioned within the door corner gasket adjacent the first sealing surface 202. These magnets facilitate the first seal along the upper portions of the French doors prior to the intermediate gaskets taking effect. Second retraction magnets 226 cause the main magnets 224 to retract as shown in both of the doors for FIG. 8. A web hinge 218 in gasket 200 also assists in retraction of the first sealing surface 202.

The French doors further include peripheral vertically extending gasket member 214 and horizontal extending gasket members 216 which typically carry magnets for securing against the refrigerator cabinet. The second sealing surface 204 of the corner sealing gasket member 200 lie in a plane 230 generally parallel to the rear surface or face 232 of the door 16. Carried by the door 16 is the horizontal extending gasket member 216 which provides a continuum sealing surface with the second sealing surface 204 of the corner sealing gasket member 200.

As can be seen in the drawings, the purpose of the corner seal gasket member is to allow the corner seal gaskets to touch each other with minimal swiping as the doors are closed.

Figure 10:
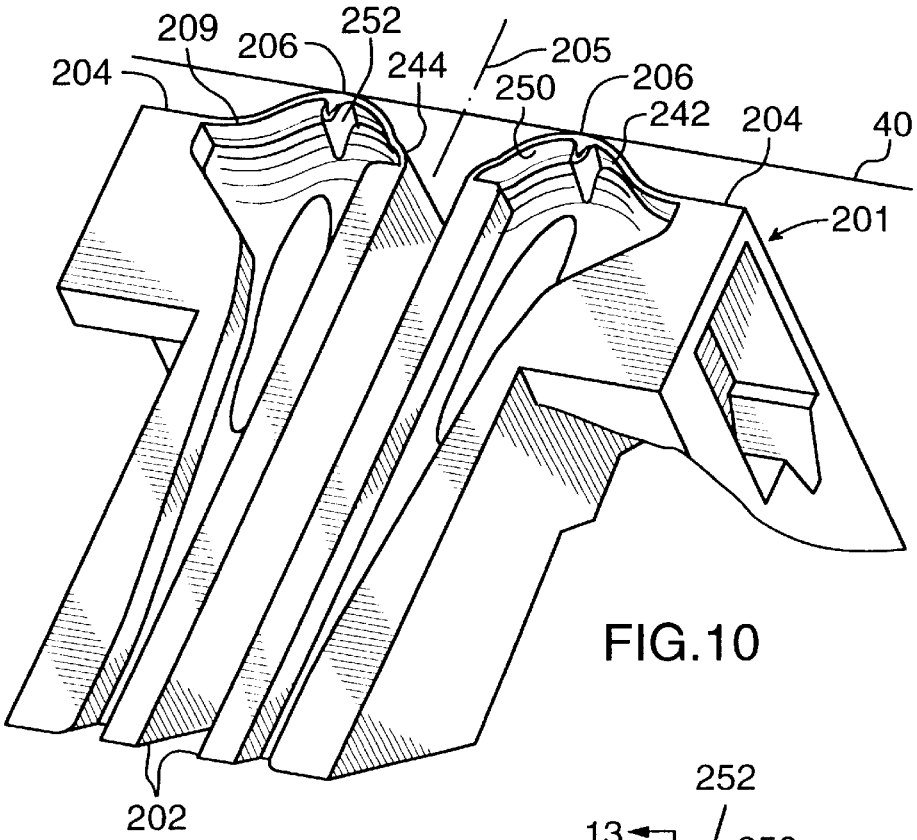
FIG. 10 is a perspective view showing the upper top wall the corner seal gasketing members of the present where the doors are slightly open.
Figure 11:
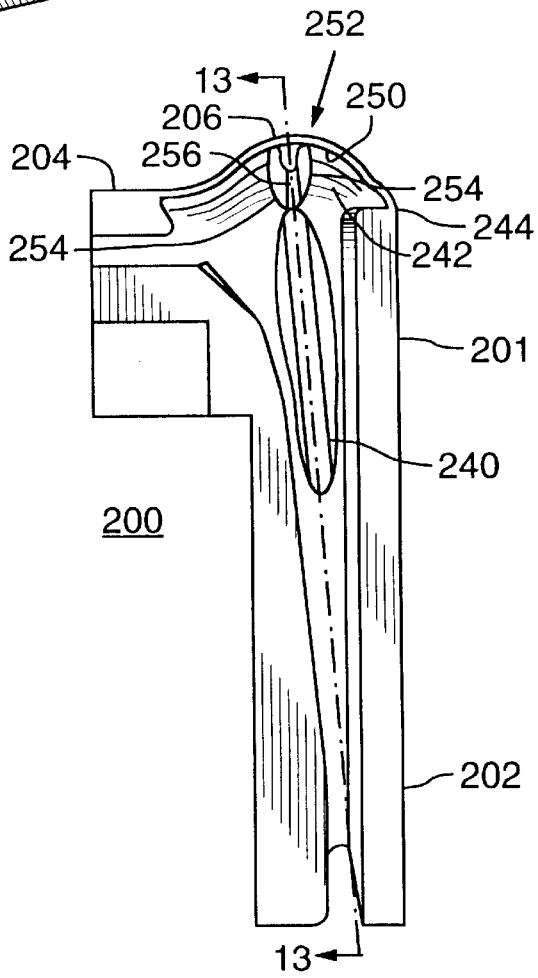
FIG. 11 is a plan view of one of the corner sealing gasketing members of the present invention.
Figure 12:
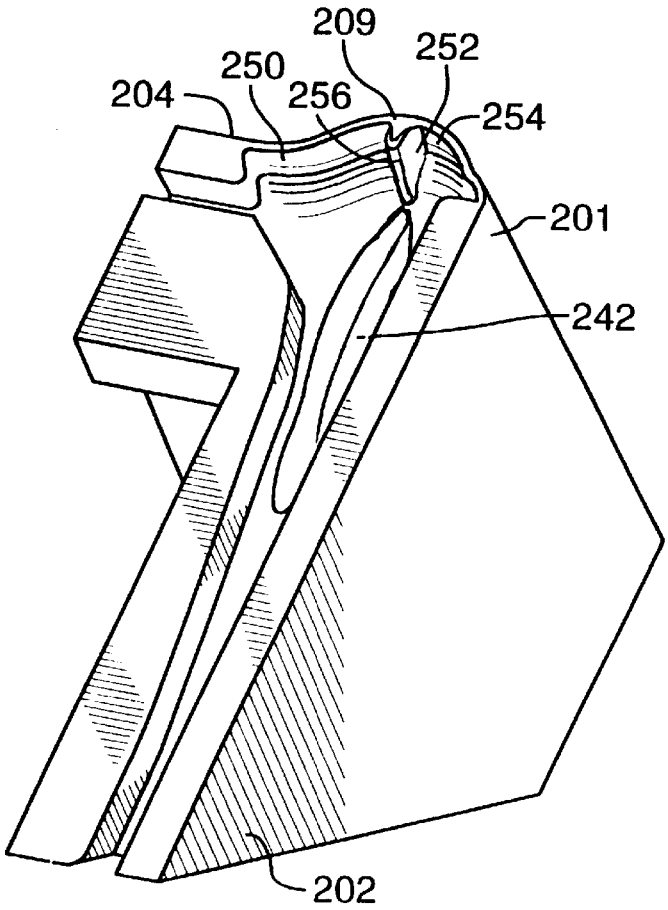
FIG. 12, is a perspective view of the one corner sealing gasketing member of FIG. 11.
Figure 13:
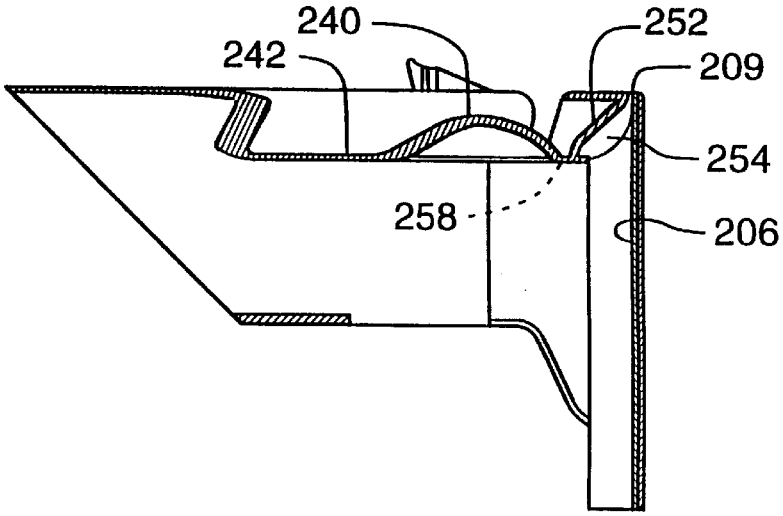
FIG. 13, is a sectional view of the one corner sealing gasketing member taken at section line 13—13 of FIG. 11.
Figure 14:
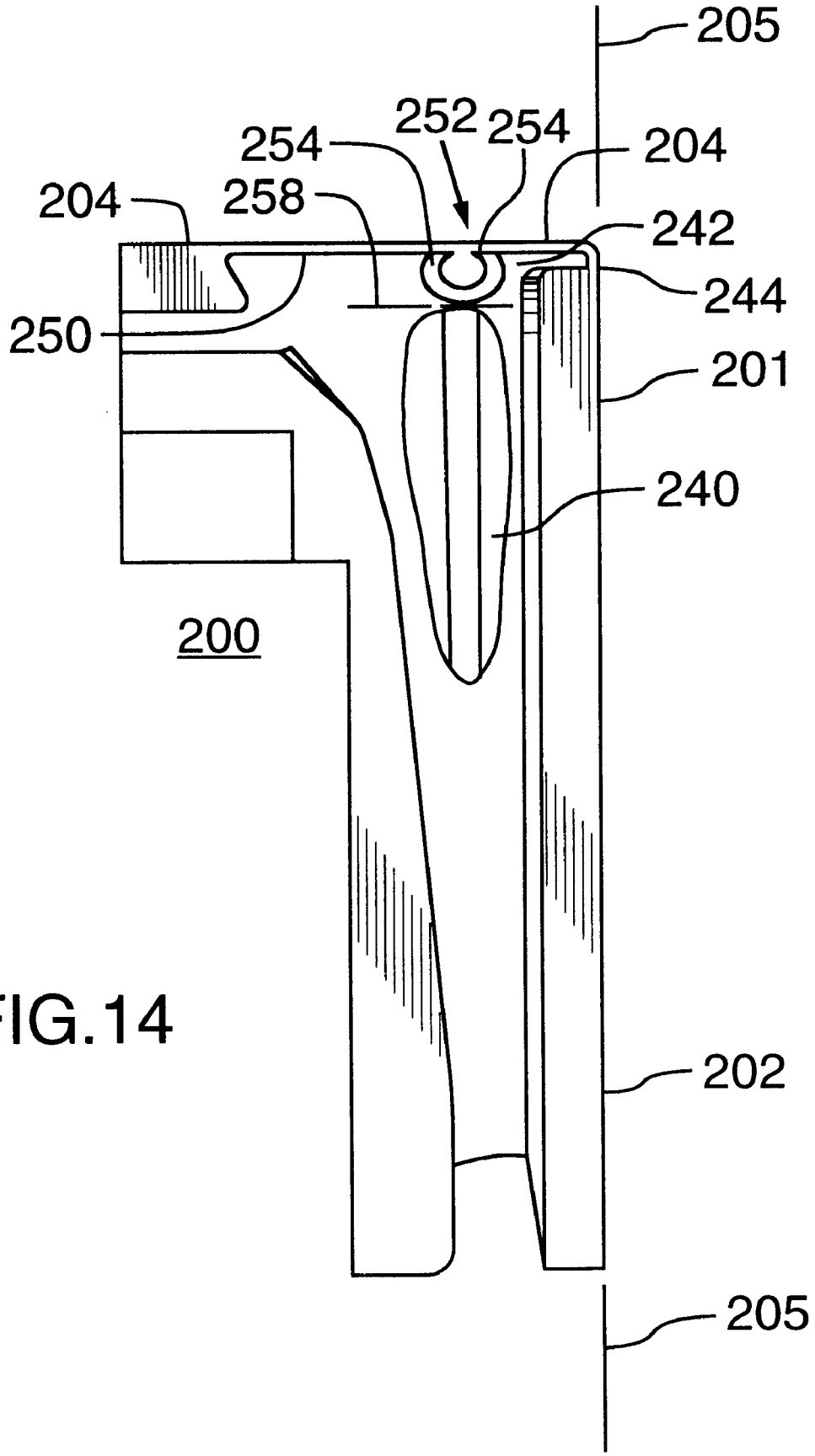
FIG. 14, is a plan view of the one corner sealing gasketing member of FIG. 11 showing the corner sealing gasketing member its closed position.
Figure 15:
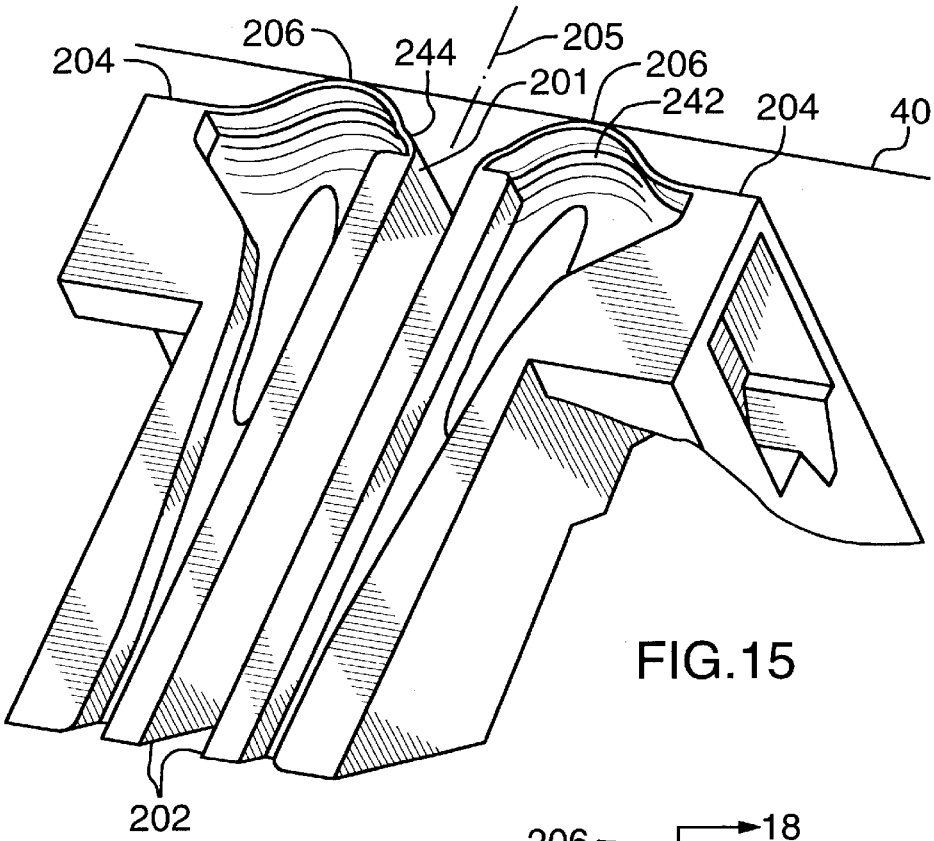
FIG. 15 is a view similar to FIG. 10 and showing an alternative embodiment for the top outer walls of the corner seal gasketing members.
Figure 16:
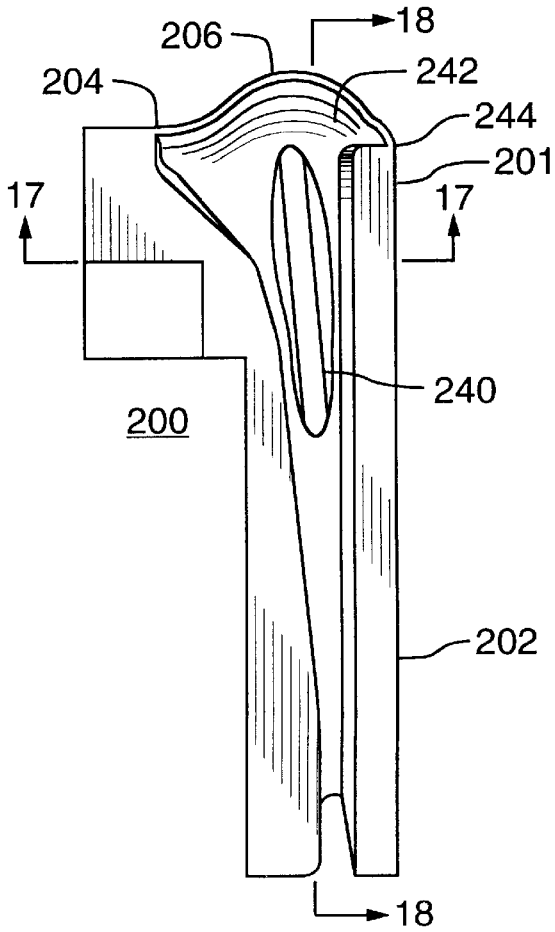
FIG. 16 is a plan view of one of the gasketing members of FIG. 15.
Figure 17:
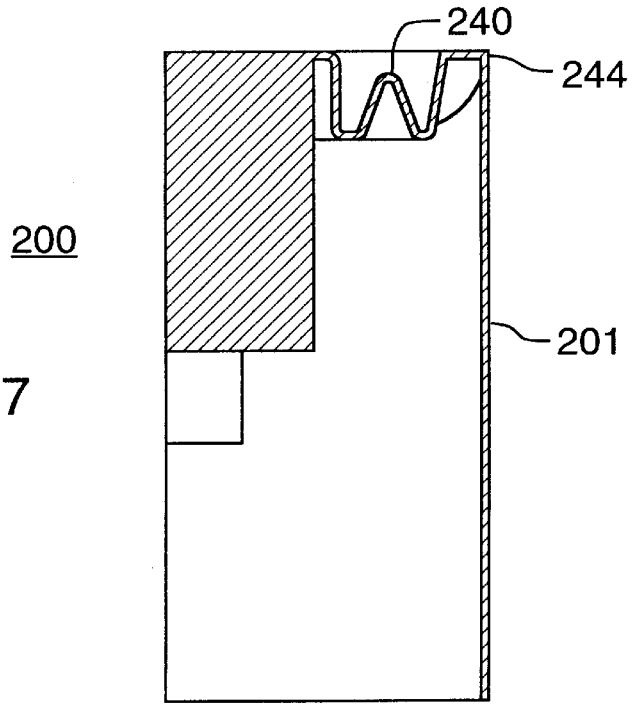
FIG. 17, is a sectional view of one of the gasketing members taken at line 17—17 of FIG. 16.
Figure 18:
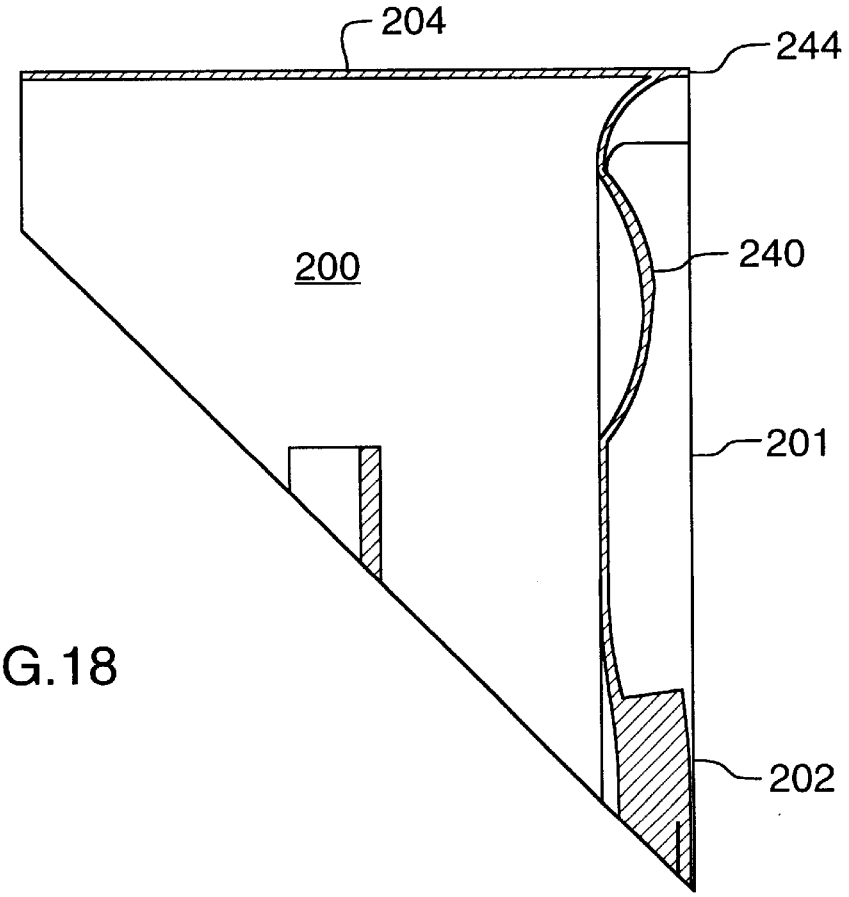
FIG. 18, is a sectional view of one of the gasketing members taken at line 18—18 of FIG. 16.

FIGS. 10 to 14 illustrate the preferred construction of the gasketing material for the corner seal gasket member 200 shown in FIGS. 3 and 7 to 9. Each of the corner sealing gasket members 200 further includes the one elongate first accordion fold 240 located on a outer surface 242 of the gasket member 200 adjacent a corner 244 where the vertical sealing surface 202 and horizontal sealing surface 204 of the gasketing member 200 meet. The elongate first accordion fold 240 extends in a direction generally parallel to the first sealing surface 202 and generally orthogonal to the second sealing surface 204 when the door is in the open position with the first sealing surface retracted 202 away from the vertically sealing position 205. This positioning is shown in FIGS. 10, 11, and 12. FIG. 14 shows the position of the gasketing material when the door is closed and the first sealing surface 202 has expanded to or reached the vertical seal closure position 205. As the first sealing surface 202 has moved towards the vertical seal position 205, the elongate first accordion fold 240 expands in width and reduces in length relative to its position shown in FIG. 11. The expansion of the first accordion fold 240 facilitates the expansion of the first ridge 206 while preventing possible tearing of the gasketing material adjacent the edge corner of the door. The elongate first accordion fold 240 has a generally semi-circular curvature along its elongation as shown in FIG. 13.

The corner seal gasketing member 200 further has a rear or inside face 250 on the opposite side of a portion of the horizontal sealing surface 204 and extending outwardly (upwardly) from the floor of outer surface 242. This inside face 250 includes a hinged second accordion fold 252 that extends down from the top or outer edge 209 horizontal sealing surface 204. Second accordion fold 252 extends down along the inside face 250 in line with the elongate first accordion fold 240. The fold 252 is centered relative to the contact ridge 206 when the door is open. The second accordion fold 252 includes two legs 254 extending outwardly from the rear surface 250 and a hinge corner 256 between the legs. As the contact ridge 206 contacts the horizontal wall 40 of the refrigerator, the contact ridge 206 flattens bringing the horizontal surface 204 into sealing engagement with the horizontal wall 40. As this happens, the second accordion fold 252 hinges about corner 256 to spread legs 254 apart from each other. However, the tips of the legs 254 adjacent the inside face 250 do not spread apart causing a buckling of the middle portion of the legs 254 as shown in FIG. 14. Also the second fold 252 moves towards the first fold 240 to create and hinge about crease 258 on the floor of surface 242. The action of the second accordion fold 252 facilitates the collapse or flattening of the contact ridge 206 improving the efficiency of the seal along the horizontal sealing surface 204 with the wall 40. The formation of the crease 258 between accordion folds 240 and 252 permits for the outer surface of the corner gasket sealing member to deform in response to the stresses associated with the closure of the door. The location of where the crease is created when the door is closed is shown as 258 with a dotted line in FIG. 13 since this Figure represents the door in an open position and the crease is not formed when the door is open position in accordance with the preferred embodiment of the present invention.

FIGS. 15 to 18 illustrate another embodiment of the construction of the gasketing material of the corner seal gasket described with respect to FIGS. 3 and 7 to 9 of the present invention. FIGS. 15 to 18 are show similar features to those described for FIGS. 10 to 14 and like numbers are used for identically functioning features to those of FIGS. 10 to 14. The embodiment shown in FIGS. 15 to 18 differs from that shown in FIGS. 10 to 14 primarily by the absence of the according fold 252. In this embodiment, as the contact ridge 206 engages wall 40, it causes the horizontal sealing surface 204 to expand and the elongate ridge 240 to expand.

Figure 19:
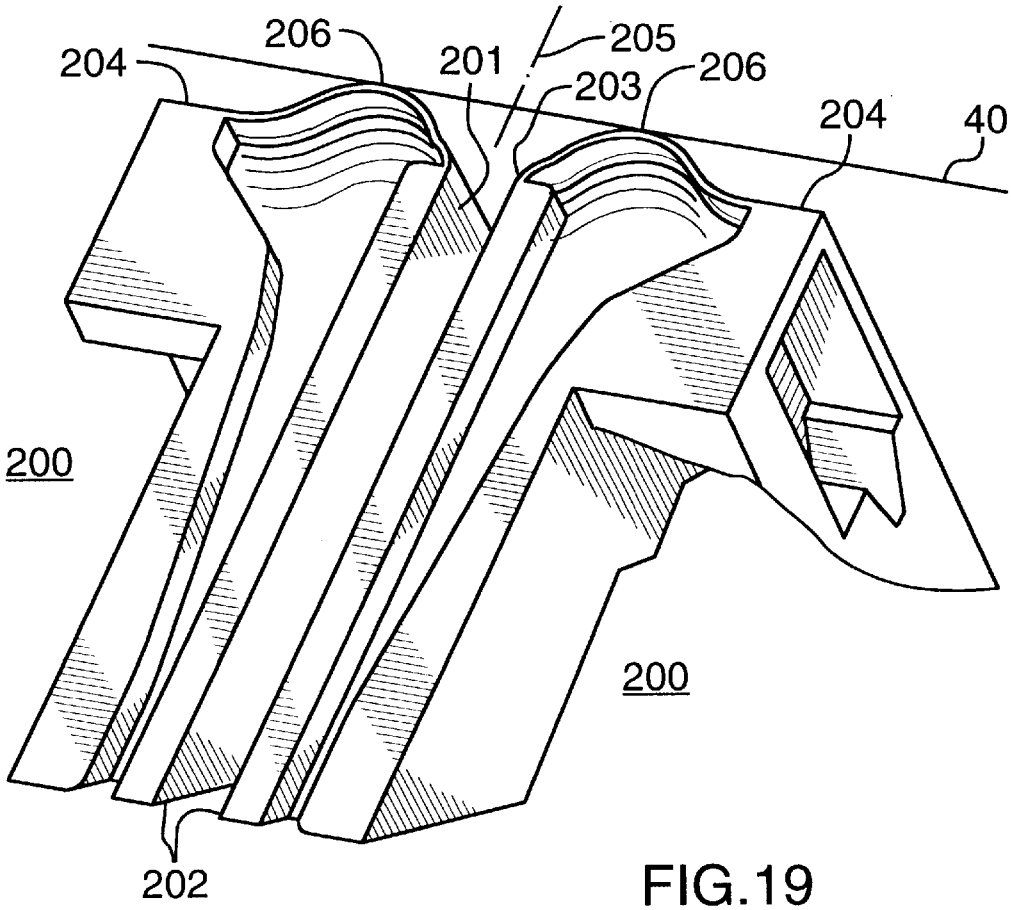
FIG. 19 is a perspective view showing an alternative embodiment for the upper top wall the corner seal gasketing members of the present where the doors are slightly open; and, FIG. 20 is a top perspective view showing an alternative embodiment for the corner gasket sealing members for two doors in a slightly open position.
Figure 20:
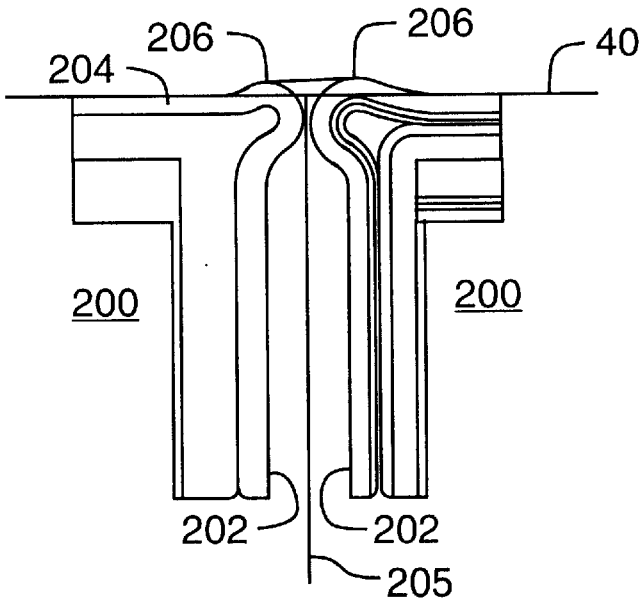

FIG. 19 illustrates another embodiment of the construction of the gasketing material of the corner seal gasket described with respect to FIGS. 3 and 7 to 9 of the present invention. FIG. 19 shows similar features to those described for FIGS. 15 to 18 and like numbers are used for identically functioning features to those of FIGS. 10 to 14. The embodiment shown in FIG. 19 differs from that shown in FIGS. 15 primarily by the absence of the elongate ridge 240. In this embodiment, as the contact ridge 206 engages wall 40, it causes the horizontal sealing surface 204 to expand.

In an alternative embodiment shown in FIG. 19, the ridge 206 is positioned between the first and second sealing surfaces 202, 204 when the doors are open. When the doors close, the ridge 206 engages a horizontal wall 40 of the refrigerator to flatten and cause the corner of the ridge 206 to expand towards the vertical seal position 205. The ridge defines a corner with the first sealing surface 202 and forms a portion of the first sealing surface 202.

It will be appreciated that alternative embodiments falling within the scope of the present invention may be apparent to those skilled in the art of refrigerator door construction and accordingly the present invention should not be limited to those embodiments herein described.

What is claimed is:

1. A refrigerator having at least one food storage compartment with an open front bounded by front facing vertical and horizontal walls, and a pair of French doors pivotally mounted to the refrigerator to close against the front facing vertical and horizontal walls and form a vertical seal between adjacent vertically extending confronting walls of the doors, and upper and lower corner sealing gasket members positioned on top and bottom ends of at least one of the doors adjacent the vertical seal and corresponding horizontal walls of the refrigerator when the door is in a closed position, each of the upper and lower corner sealing gasket members including:

a first sealing surface having a vertical seal position where the first sealing surface generally forms a continuum of the vertical seal between the confronting walls when the doors are in a closed position; and, a second sealing surface generally orthogonal to the first sealing surface, the second sealing surface when the one door is in an open position having at least one vertically extending protruding ridge contracting the second sealing surface to withdraw the first sealing surface away from the vertical seal position, the ridge engaging a corresponding horizontal wall as the door closes to flatten the second sealing surface into sealing engagement with the corresponding horizontal wall and to advance the first sealing surface towards the vertical seal position when both doors are closed.

2. The refrigerator of claim 1 wherein the vertically extending ridge contracts horizontally to withdraw with horizontal displacement the first sealing surface away for the vertical seal position.

3. The refrigerator of claim 2 wherein there is one ridge having a generally arcuate cross-section when the one door is open.

4. The refrigerator of claim 3 wherein the arcuate cross-section of the one ridge has a radius when the door is open that is proportional to the horizontal displacement of the first sealing surface when the door is closed.

5. The refrigerator of claim 1 wherein each of the corner sealing gasket members further includes at least one elongate first accordion fold located on a outer surface of the gasket member adjacent a corner where the vertical and horizontal sealing surfaces meet, the elongate first accordion fold extending in a direction generally parallel to the first sealing surface and generally orthogonal to the second sealing surface when the door is in the open position with the first sealing surface retracted away from the vertically sealing position, the first accordion fold expanding in width as the first sealing surface moves towards the vertical seal position.

6. The refrigerator of claim 5 wherein the elongate first accordion fold has a generally semi-circular curvature along its elongation.

7. The refrigerator of claim 5 wherein the elongate ridge is canted inwardly away from the vertical sealing position and towards the second sealing surface.

8. The refrigerator of claim 5 wherein the elongate first accordion fold is located on an outer surface of the gasketing member.

9. The refrigerator of claim 5 wherein each of the corner sealing gasket members further has an inside face on a side opposite to the second sealing surface and a hinged second accordion fold extending along the inside face in line with the elongate first accordion fold.

10. The refrigerator of claim 9 wherein the fold is centered relative to the vertically extending ridge when the door is open.

11. The refrigerator of claim 10 wherein the second accordion fold includes two legs extending outwardly from the inside face and a hinge corner between the legs, the legs buckling from each other when the vertical ridge is flattened, and the second accordion fold and the first accordion fold creating a crease in the gasketing member as the door closes and the first and second accordion folds hinging about the crease during door closure.

12. The refrigerator of claim 11 wherein the second sealing surface includes and outer edge downwardly from which the second accordion fold extends.

13. The refrigerator of claim 1 wherein each of the upper and lower corner gasket members forms a vertically extending corner where the first sealing surface meets the second sealing surface.

14. The refrigerator of claim 1 further including first magnets located adjacent the first and second sealing surfaces of the corner sealing gasket members for forming the vertical seal adjacent the front facing horizontal walls.

15. The refrigerator of claim 14 wherein the front facing horizontal walls include magnetic attraction members adjacent the vertical seal to attract the first magnets towards the front facing horizontal walls.

16. The refrigerator of claim 15 further including vertically extending second magnets positioned in the corner sealing gasket members adjacent the first sealing surface for mutual attraction to form the vertical seal.

17. The refrigerator of claim 16 wherein the corner gasket sealing member includes a hinge web along a surface forward of the first sealing surface and further including second retraction magnets located in each of the corner sealing gasket members spaced rearwardly from the second magnets to attract the second magnets to the second retraction magnets withdrawing the first sealing surface away from the vertical seal when at least one door is open.

18. The refrigerator of claim 15 further including first retraction magnets located in each of the corner sealing gasket members spaced rearwardly from the first magnets to attract the first magnets to the first retraction magnets withdrawing the first sealing surfaces from the vertical seal when the one door is open.

19. The refrigerator of claim 1 wherein each of the corner sealing gasket members further has an inside face on a side opposite to the second sealing surface and a hinged second accordion fold extending along the inside face in line with the elongate first accordion fold.

20. The refrigerator of claim 19 wherein the fold is centered relative to the vertically extending ridge when the door is open.

21. The refrigerator of claim 19 wherein the second accordion fold includes two legs extending outwardly from the inside face and a hinge corner between the legs, the legs buckling from each other when the vertical ridge is flattened.

22. The refrigerator of claim 21 wherein the second sealing surface includes and outer edge downwardly from which the second accordion fold extends.

23. The refrigerator of claim 1 wherein the ridge further defines a corner with the first sealing surface and forms a portion of the first sealing surface.

24. The refrigerator of claim 1 wherein both the doors include the upper and lower corner sealing gaskets, the first sealing surface of the corner sealing gaskets extending horizontally from the confronting side wall of the door rearwardly toward the food compartment beyond a rear face of the door when the door is closed, and the second sealing surface extending horizontally in a plane parallel to the rear face of the door when the door is in a closed position.

25. The refrigerator of claim 1 wherein the pair of French doors are pivotally mounted to the refrigerator cabinet, the doors having peripheral vertical extending and horizontal extending gasket members mounted adjacent periphery edge surfaces of the doors for respective sealing engagement with the front facing vertical and horizontal walls of the refrigerator cabinet when the doors are in a closed position.

26. The refrigerator of claim 1 wherein the second sealing surface forms a continuum with a corresponding one of the horizontal sealing gasket members.

27. A refrigerator comprising:

a refrigerator cabinet having at least one food storage compartment with an open front bounded by front facing vertical and horizontal walls;

a pair of French doors pivotally mounted to the refrigerator cabinet to close against the front facing vertical and horizontal walls when the doors are in a closed side by side position, in the closed position the doors including adjacent vertically extending confronting walls comprising:

intermediate sealing gasket members each extending along a major vertical portion of at least one of the confronting walls and adapted to sealingly engage against each to form a vertical extending seal; and, upper and lower corner sealing gasket members respectively positioned above and below the intermediate sealing gasket members and adjacent a corresponding horizontal wall of the cabinet; and, each of the upper and lower corner sealing gasket members including:

a first sealing surface having a vertical seal position where the first sealing surface generally forms a continuum of the adjacent intermediate sealing gasket member to complete the vertical seal between confronting walls of the doors when the doors are in the closed position; and, a second sealing surface generally orthogonal to the first sealing surface, the second sealing surface when in the open position having at least one vertically extending, outwardly protruding ridge contracting the second sealing surface to withdraw the first sealing surface back from the vertical seal position, the ridge engaging one of the horizontal walls as the door closes to flatten the second sealing surface into sealing engagement with the one corresponding horizontal wall and to advance the first sealing surface towards the vertical seal position when both doors are closed.

28. The refrigerator of claim 27 wherein the vertically extending ridge contracts horizontally to withdraw with horizontal displacement the first sealing surface back from the vertical sealing position.

29. The refrigerator of claim 28 wherein there is one ridge having a generally arcuate cross-section when the one door is closed.

30. The refrigerator of claim 29 wherein the arcuate cross-section of the one ridge has a radius when the door is open that is proportional to the horizontal displacement of the first sealing surface when the door is closed.

31. The refrigerator of claim 30 wherein each of the corner sealing gasket members further has an inside face on a side opposite to the second sealing surface and a hinged second accordion fold extending along the inside face in line with the elongate first accordion fold.

32. The refrigerator of claim 27 wherein each of the corner sealing gasket members further includes at least one elongate first accordion fold located on a outer surface of the gasket member adjacent a corner where the vertical and horizontal sealing surfaces meet, the elongate first accordion fold extending in a direction generally parallel to the first sealing surface and generally orthogonal to the second sealing surface when the door is in the open position with the first sealing surface retracted away from the vertically sealing position, the first accordion fold expanding in width as the first sealing surface moves towards the vertical seal position.

33. The refrigerator of claim 32 wherein the elongate first accordion fold has a generally semi-circular curvature along its elongation.

34. The refrigerator of claim 32 wherein the elongate ridge is canted inwardly away from the vertical sealing position and towards the second sealing surface.

35. The refrigerator of claim 32 wherein the elongate first accordion fold is located on an outer surface of the gasketing member.

36. The refrigerator of claim 27 wherein both the doors include upper and lower corner sealing gaskets, the first sealing surface of the corner sealing gaskets extending horizontally from the confronting side wall of the door rearwardly toward the food compartment beyond a rear face of the door, and the second sealing surface extending horizontally in a plane parallel to the rear face of the door when the door is in a closed position.

37. The refrigerator of claim 27 wherein the pair of French doors are pivotally mounted to the refrigerator cabinet, the doors having peripheral vertical extending and horizontal extending gasket members mounted adjacent periphery edge surfaces of the doors for respective sealing engagement with the front facing vertical and horizontal walls of the refrigerator cabinet when the doors are in a closed position.

38. The refrigerator of claim 27 wherein the second sealing surface forms a continuum with a corresponding one of the horizontal sealing gasket members.

39. The refrigerator of claim 27 wherein each of the upper and lower corner gasket members forms a vertically extending corner where the second sealing surface meets the first sealing surface.

40. The refrigerator of claim 39 wherein the front facing horizontal walls include magnetic attraction members adjacent the vertical seal to attract the first magnets towards the front facing horizontal walls.

41. The refrigerator of claim 40 wherein the corner gasket sealing member includes a hinge web along a surface forward of the first sealing surface and further including second retraction magnets located in each of the corner sealing gasket members spaced rearwardly from the second magnets to attract the second magnets to the second retraction magnets withdrawing the first sealing surface away from the vertical seal when at least one door is open.

42. The refrigerator of claim 27 further including first magnets located adjacent the first and second sealing surfaces of the corner sealing gasket members for forming the vertical seal adjacent the front facing horizontal walls.

43. The refrigerator of claim 42 further including vertically extending second magnets positioned in the corner sealing gasket members adjacent the first sealing surface for mutual attraction to form the vertical seal.

44. The refrigerator of claim 42 further including first retraction magnets located in each of the corner sealing gasket members spaced rearwardly from the first magnets to attract the first magnets to the first retraction magnets withdrawing the first sealing surfaces from the vertical seal when the one door is open.

45. The refrigerator of claim 44 wherein the second accordion fold includes two legs extending outwardly from the inside face and a hinge corner between the legs, the legs buckling from each other when the vertical ridge is flattened.

46. The refrigerator of claim 44 wherein the fold is centered relative to the vertically extending ridge when the door is open.

47. The refrigerator of claim 46 wherein the second sealing surface includes and outer edge downwardly from which the second accordion fold extends.

48. The refrigerator of claim 47 wherein the second accordion fold includes two legs extending outwardly from the inside face and a hinge corner between the legs, the legs buckling from each other when the vertical ridge is flattened, and the second accordion fold and the first accordion fold creating a crease in the gasketing member as the door closes and the first and second accordion folds hinging about the crease during door closure.

49. The refrigerator of claim 47 wherein the fold is centered relative to the vertically extending ridge when the door is open.

50. The refrigerator of claim 49 wherein the second sealing surface includes and outer edge downwardly from which the second accordion fold extends.

51. The refrigerator of claim 27 wherein each of the corner sealing gasket members further has an inside face on a side opposite to the second sealing surface and a hinged second accordion fold extending along the inside face in line with the elongate first accordion fold.

52. The refrigerator of claim 27 wherein the ridge further defines a corner with the first sealing surface and forms a portion of the first sealing surface.

* * * * *

UNITED STATES PATENT AND TRADEMARK OFFICE

CERTIFICATE OF CORRECTION

PATENT NO. : 5,975,664
DATED : November 2, 1999
INVENTOR(S) : Banicevic et al.

It is certified that error appears in the above-identified patent and that said Letters Patent is hereby corrected as shown below:

Column 12, claim 11,
Line 43, The refrigerator of claim "10" should read -- 9 --.

Signed and Sealed this

Twenty-ninth Day of January, 2002

*Attest:*

*Attesting Officer*

JAMES E. ROGAN
*Director of the United States Patent and Trademark Office*